United States Patent [19]

Larson et al.

[11] 4,047,933

[45] Sept. 13, 1977

[54] POROSITY REDUCTION IN INERT-GAS ATOMIZED POWDERS

[75] Inventors: Jay Michael Larson, Warwick; Ian Sidney Rex Clark, Greenwood Lake, both of N.Y.; Robert Cameron Gibson, Ringwood, N.J.

[73] Assignee: The International Nickel Company, Inc., New York, N.Y.

[21] Appl. No.: 692,312

[22] Filed: June 3, 1976

[51] Int. Cl.[2] ..... B22D 23/08

[52] U.S. Cl. ..... 75/.5 C; 264/12

[58] Field of Search ..... 75/.5 C, .5 B, .5 BA, 75/.5 BB, .5 BC; 264/12

[56] References Cited

U.S. PATENT DOCUMENTS 3,907,552 9/1975 Kennedy ..... 75/122

OTHER PUBLICATIONS

Gummeson, P.U., "Modern Atomizing Techniques," Powder Metallurgy, vol. 15, No. 29, 1972, pp. 67–94.

*Primary Examiner*—W. Stallard

*Attorney, Agent, or Firm*—Walter A. Petersen; Ewan C. MacQueen; Raymond J. Kenny

[57] ABSTRACT

Thermally induced porosity, which can lead to cracking in metal powders after consolidation, is believed to be caused by the entrapment of the inert gas used for atomization within the metal powders. The addition of an activating agent to the molten alloy prior to atomization with an inert gas, such as argon, serves to substantially reduce the porosity of metal powders. Suitable activating agents are characterized by an ability to rapidly diffuse to the surface of a molten metal particle and an affinity for oxygen. Activating agents that are useful for high nickel alloys and highly alloyed steels include magnesium, calcium, lithium, silicon, and rare earths.

14 Claims, 2 Drawing Figures

POROSITY REDUCTION IN INERT-GAS ATOMIZED POWDERS

Figure 1:
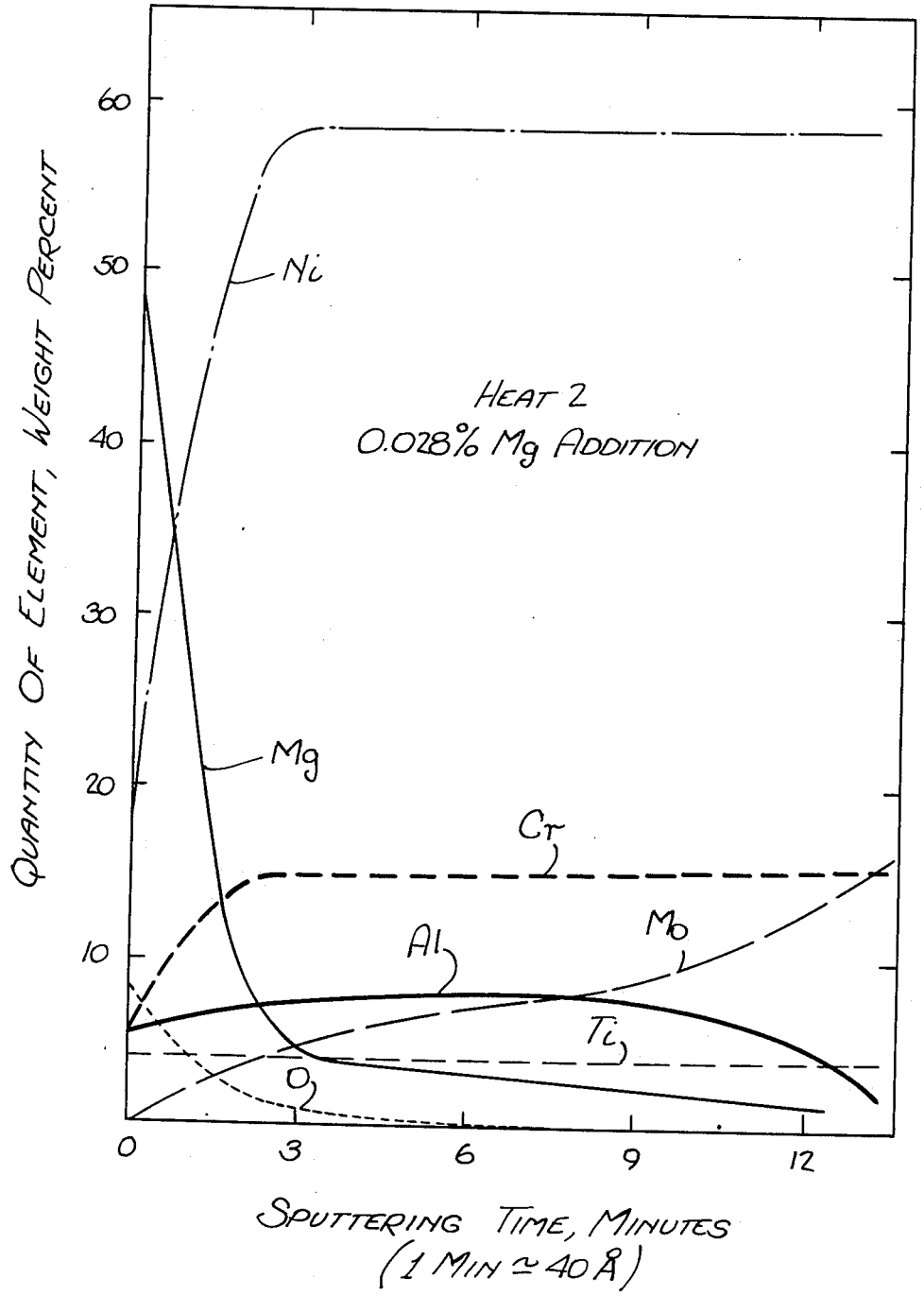

The present invention is directed to a process for substantially lowering porosity in inert gas atomized metal powders.

The use of metal powders for the preparation of various articles of manufacture has become an accepted production technique within recent years. Metal powders can be used in elemental form; however, for more highly alloyed metals, such as those used in the production of complex superalloy parts, e.g., gas turbine wheels and blades, alloyed metal powders are desired by virtue of their improved characteristics, e.g., shape, gas content, homogeneity, etc.

Although elemental metals and simple alloys can be converted to powder form by subjecting a molten stream of metal to contact with high-velocity water, the more highly alloyed metal powders are advantageously produced by impinging a stream of the molten alloy with a high-velocity stream of an inert gas. A relatively pure inert gas such as argon is routinely used for atomization of superalloy powders.

Many metal parts have been successfully produced from gas atomized metal powdes; however, in some instances the presence of porous areas in compacts consolidated by hot pressing has been associated with the presence of inert gas originally entrapped within some of the powder particles. This type of porosity is termed thermally induced porosity. Such porosity is undesirable since it can cause cracking in a subsequent forging operation as well as adversely affect the mechanical properties.

Producers of atomized metal powders have found that the largest powder particles have the largest amount of entrapped argon. Thermally induced porosity in the consolidated compacts can be substantially reduced by removal of the larger powder particles from the charges used to prepare them. However, this method of reducing porosity is not satisfactory since as much as half of the metal powder can comprise the coarse powder fraction which is reverted to the scrap circuit.

Highly reactive elements such as Mg, Ca, Li, Zr, and Ti have been added on numerous occasions to various highly alloyed metals. These additions are generally made to enhance properties such as hot workability of wrought alloys and weldability of wrought and cast alloys, but not for the purpose of imparting desirable characteristics to metal powders. However, in one known instance, U.S. Pat. No. 2,870,485, magnesium, calcium, lithium, zirconium, and titanium additions have been made to copper melts prior to water atomization for the purpose of providing low apparent density. The reduction in apparent density, the weight of a unit volume of powder, taught in this patent provides a loosely packed, fluffy powder which is antithetic and distinct from the high density requirements established for metal and alloy powders by the producers of gas atomized metals.

It has now been discovered that inert gas porosity in metal powders and the resultant thermally induced porosity in consolidated compacts associated with the use of an inert gas atomization process can be substantially reduced by the addition of a small amount of an activating agent to the molten metal alloy prior to its atomization with an inert gas stream.

Figure 2:
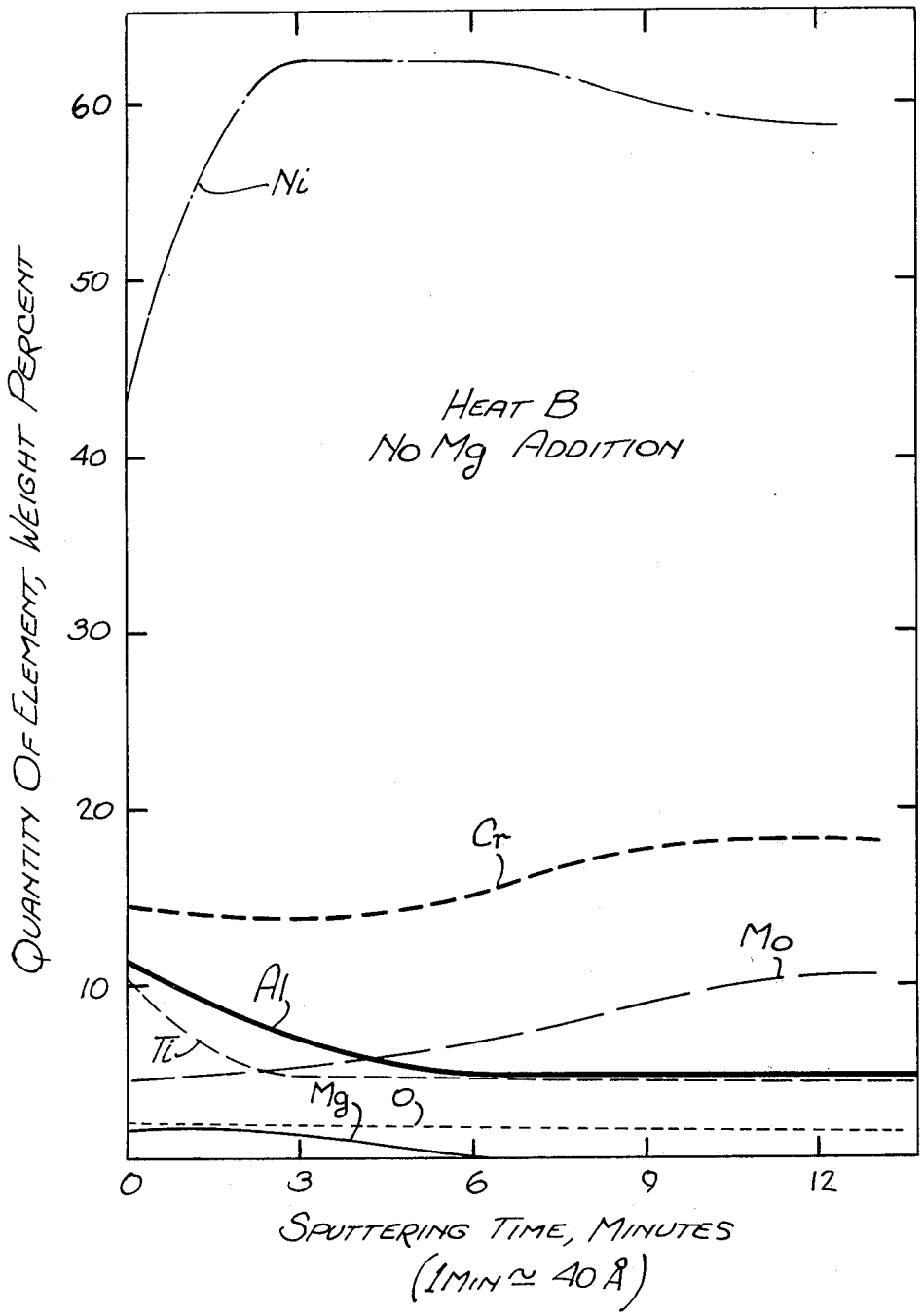

FIG. 1 and FIG. 2 show the distribution of elements in the surface layer of metal powder particles.

Generally speaking, the present invention substantially reduces gas entrapment in an inert gas atomized metal powder and comprises melting a metal alloy, activating the metal alloy melt by addition of an activating agent, and atomizing the molten metal alloy containing the activating agent by contact with a high-velocity inert gas.

The process is preferably used during the atomization of high-nickel alloys and highly alloyed steels, although it is contemplated that the process can be used for virtually any metal or alloy subjected to inert gas atomization. High-nickel alloys, particularly superalloys, and highly alloyed steels, particularly tool steels, are amenable to the practice of this invention since these materials are generally atomized using an inert gas stream rather than water or air atomization. High-nickel alloys used for the preparation of gas turbine wheels and blades are particularly suited to the practice of this invention. Such alloys contain from about 10 to about 30% chromium, up to about 50% iron, up to about 20% cobalt, up to about 30% molybdenum, up to about 12% tungsten, up to about 8% tantalum, up to about 7% aluminum, up to about 5% titanium, up to about 4% columbium, up to about 0.1% boron, up to about 0.1% zirconium, and the balance essentially nickel. A specific example of a high-nickel alloy is one containing: 0.03% C, 15% Cr, 5% Mo, 17% Co, 4% Al, 3.5% Ti, 0.03% B, and the balance Ni. The total gas content of such metal powders is less than about 0.03% by weight.

An inert gas is used for atomization to substantially avoid oxidation and loss of highly reactive ingredients such as chromium, aluminum, titanium, etc., from high-nickel alloys and highly alloyed steels. The inert gas generally used for atomization of such alloys is argon. This gas is selected because of its cost, availability, and very low oxygen content. Other inert gases such as helium, as well as mixtures of these gases with other inert gases, can be used in the practice of this invention; however, cost and availability are usually considered prohibitive. Mixtures of relatively pure nitrogen with inert gases can be used where formation of nitrides does not deplete the alloy of essential ingredients or degrade requisite properties in pressed and sintered compacts.

A suitable activating agent is characterized by its ability to rapidly diffuse to the surface of a molten particle as well as affinity for and combination with oxygen. Activating agents suitable for this purpose can be selected from a group consisting of magnesium, calcium, lithium, silicon, and rare earths.

The elements which serve as the activating agent should be added to the molten alloys prior to inert gas atomization in amounts ranging from about 0.001 to about 0.1%. When added in amounts less than 0.001%, there is no significant reduction in the amount of general porosity in the metal powders. With more than about 0.08% of these elements present, deterioration in the hot workability and the strength of these materials is found. It is preferred that from about 0.007 to about 0.08% of the elements used as activating agents be added to the molten alloys prior to inert gas atomization to achieve a residual of at least about 0.007% in the molten alloy.

Magnesium is one of the preferred activating agents useful for the practice of this invention. This element can be added to the molten metal bath prior to gas atomization in the form of a master alloy. A nickel-magnesium master alloy containing from about 5 to about 20% magnesium, e.g., 15% magnesium, has been used for this purpose. Other magnesium alloys such as silicon-magnesium as well as elemental magnesium are also suitable for this purpose and can be substituted in the practice of this invention.

The element calcium is also a preferred activating agent and can be added to the molten alloy as a master alloy prior to gas atomization. A nickel-calcium master alloy containing from about 3 to about 15% calcium, e.g., 5% calcium, has been found to be useful for the practice of this invention. Other calcium-containing master alloys, e.g., calcium-iron, calcium-silicon, etc., are also of use and can be substituted for nickel-calcium.

Since the elements suitable as activating agents are extremely reactive, it is preferred that the alloys to which they are added be gas atomized immediately after addition. That is, these elements have a strong tendency to react with oxygen, e.g., the oxides of the furnace lining, and to be removed from the melt as a surface slag. Also, since they are highly volatile and are added to the melt in many instances under a partial vacuum, as a result of volatilization they may not be available to interact during the gas atomization process to provide the desired resistance to gas entrapment.

It is contemplated that mixtures of the two preferred activating agents, magnesium and calcium, in various proportions can be used in the practice of this invention. A mixture of these ingredients can provide beneficial hot working characteristics and mechanical properties since neither element will then be present in an excessive amount in the gas atomized powder.

The activating agents lithium, silicon and rare earths can be added in the form of a lithium-containing master alloy, silicon metal, and mischmetal, respectively.

In addition to the benefit provided by an activating agent added to the molten metal prior to atomization, there are several other variables that affect the porosity of atomized powders. These variables provide minor changes in the porosity characteristics of the powders as compared to the effects provided by the addition of activating agents.

The pressure of the argon gas should be kept relatively low to provide a desirable particle size distribution. Too low a pressure can lead to insufficient energy to atomize the stream into fine particles and result in a large coarse fraction, whereas when pressures are extremely high, there is a greater tendency for collision of energetic particles which is believed to result in greater porosity. Gas pressures between about 275 and 4140 kPa (40 and 600 psig) are useful for atomization of molten metal. However, it is preferred to use gas pressures between about 1030 and 1240 kPa (150 and 180 psig).

Atomization requires superheating metals to temperatures in excess of their melting points. If insufficient superheat is used, a not entirely desirable large, coarse fraction results with the attendant risk of solidification within the tundish. Superheating to too high a temperature leads to increased entrapment of inert gas. This can be due in part to increased solution of the inert gas, but more likely is due to the increased time that particles are in the liquid state. With high superheats, more frequent collisions between particles results in entrapment of larger quantities of argon. Superheating to temperatures of about 85° to about 135° C above the melting point of the metal being atomized has been found to be effective in providing sufficient superheat for atomization with minimization of the amount of argon entrapped.

Inert gas jets should be aligned to converge at a single point. Such accurate alignment provides fewer particle/particle collisions and hence, less porosity. However, since a single gas impact point can lead to undesirable splash-back of powder onto the gas jets, it is more desirable to use more than one impact point; and consequently, it is preferred to align the gas jets at more than one location. The number of gas jets was found to provide no significant effect on porosity. That is, when four gas jets were used, the amount of porosity was essentially the same as when eight gas jets were used.

For the purpose of giving those skilled in the art a better understanding of the invention, the following illustrative examples are given:

EXAMPLE I

Two 45-kilogram heats were vacuum melted in an induction furnace. A 0.06% magnesium addition, in the form of a nickel, 15% magnesium master alloy, was made to Heat 1 at 1540° C under about ½ atmosphere argon (0.011% magnesium recovered in the powder). Heat A was prepared under essentially the same conditions, except that magnesium was not added.

The jets used for atomization consisted of four spaced 90° apart and inclined 11° from the vertical axis and four alternately spaced and inclined 12½° from the vertical axis of the molten metal stream. The 3.8cm long venturi jets had a 4mm throat diameter and were arranged in an 8cm diameter circle centered on the axis of the metal stream. The molten metal was tapped into a tundish preheated to 1200° C and teemed through a 7.5mm diameter nozzle at an average rate of about 23 kg/min. The metal stream was atomized by passing argon through the jets at pressures ranging from 480 to 1240 kPa (70–180 psig). The kinetic energy per second at nozzle exit was about 4400 watts.

Following atomization, the heats were sieved into six screen mesh sizes. Table II shows the size distribution of the powder particles, the oxygen contents, and apparent densities of these powders.

Measurement of relative argon porosity was accomplished by a quantitative metallographic technique. It was found that the magnesium-containing powder, Heat 1, had considerably less porosity than the powder from the magnesium-free Heat A and that the majority of the porosity resided in the coarse powder fraction.

TABLE I

| | COMPOSITIONS OF ATOMIZED POWDERS COMPOSITION IN WEIGHT PERCENT, BALANCE NICKEL | | | | | | | | | | | |
|---|---|---|---|---|---|---|---|---|---|---|---|---|
| HEAT | Cr | Mo | Ti | Al | C | Co | Mg | Ca | B | Zr | O | N |
| 1 | 14.6 | 5.0 | 3.3 | 4.0 | 0.021 | 16.9 | 0.011 | N.A. | 0.020 | N.A. | 0.0052 | |
| 2 | 15.2 | 5.1 | 3.5 | 4.2 | 0.031 | 17.1 | 0.028 | N.A. | 0.028 | 0.01 | 0.0075 | 0.0015 |
| 3 | 14.3 | 5.1 | 4.0 | 4.0 | 0.024 | 16.6 | N.A. | 0.0076 | 0.025 | N.A. | 0.0073 | |
| 4 | 15.4 | 5.2 | 3.4 | 4.0 | 0.033 | 17.0 | 0.018 | N.A. | 0.024 | N.A. | 0.0067 | 0.0021 |
| A | 15.1 | 5.2 | 3.1 | 3.9 | 0.024 | 17.4 | N.A. | N.A. | 0.028 | N.A. | 0.0094 | |
| B | 15.0 | 5.1 | 3.4 | 4.2 | 0.028 | 17.2 | N.A. | N.A. | 0.020 | 0.01 | 0.0055 | 0.0012 |

N.A. = Not Added

Pycnometer measurements contained in Table II also showed that Heat 1 was less porous than Heat A in that the apparent density of powders from Heat 1 was greater than the apparent density of powder from Heat A for all fractions.

EXAMPLE II

This example shows the existence of a concentrated layer of the activating agent magnesium on the surface of metal powders prepared from magnesium-containing melts.

Heat 2, having the composition shown in Table I, was prepared and argon atomized in a manner similar to that described for Heat 1, except that the argon pressure ranged from 690 to 1030 kPa (100 to 150 psig).

Auger spectroscopy of the magnesium-containing metal powders from Heat 2 showed that magnesium was concentrated at the surface of the powder. FIG. 1 represents a composition versus depth profile for powder from this heat. (Sputtering time is directly related to the depth undergoing analysis.) Similar information is provided in FIG. 2 for a magnesium-free Heat B which was prepared in the same manner as Heat 2.

The surprising enrichment of magnesium on the surface of the powder (effective thickness of about 120 angstroms) shown in FIG. 1 is believed to be due to the rapid diffusion of magnesium atoms to the powder surface to lower surface tension. Such concentrations of a highly reactive element on the surface of the powders is believed to promote rapid reaction with oxygen contaminants in the inert gas stream to form an oxidized surface layer on the particles thereby making them resistant to penetration by other particles during collision and thereby substantially lowering the level of inert gas entrapment.

TABLE II

Size Distribution, Oxygen Content, Porosity And Apparent Density Of Metal Powders Prepared From Magnesium-Containing And Magnesium-Free Heats

| Mesh Size | −40 +60 | −60 +80 | −80 +100 | −100 +200 | −200 +325 | −325 |
|---|---|---|---|---|---|---|
| | | | HEAT 1 | | | |
| Weight, % | 15.6 | 16.9 | 10.6 | 34.3 | 12.3 | 5.6 |
| Oxygen, % | 0.0033 | 0.0039 | 0.0039 | 0.0046 | 0.0082 | 0.0150 |
| Porosity, % | 0.90 | 0.54 | 0.54 | 0.41 | 0.19 | 0.00 |
| Apparent Density, g/cm³ | 7.89 | 8.11 | 8.11 | 7.98 | 7.93 | 7.98 |
| | | | Heat A | | | |
| Weight, % | 13.3 | 11.2 | 10.2 | 35.6 | 15.5 | 8.6 |
| Oxygen, % | 0.0074 | 0.0090 | 0.0086 | 0.0084 | 0.0100 | 0.0180 |
| Porosity, % | 3.3 | 3.3 | 1.1 | 0.5 | 0.17 | 0.00 |
| Apparent Density, g/cm³ | 7.75 | 7.82 | 7.87 | 7.88 | 7.91 | 7.91 |
| | | | HEAT 2 | | | |
| Weight, % | 24.8 | 14.9 | 14.1 | 26.4 | 7.1 | 3.4 |
| Oxygen, % | 0.0023 | 0.0027 | 0.0033 | 0.0041 | 0.0068 | 0.0140 |
| Porosity, % | 1.13 | 0.88 | 0.44 | 0.10 | 0.24 | 0.21 |
| | | | HEAT B | | | |
| Weight, % | 19.8 | 14.7 | 12.8 | 27.7 | 8.1 | 3.9 |
| Oxygen, % | 0.0044 | 0.0047 | 0.0048 | 0.0044 | 0.0063 | 0.0092 |
| Porosity, % | 3.30 | 2.79 | 2.04 | 0.85 | 0.91 | 0.88 |
| | | | HEAT 3 | | | |
| Weight, % | 18.3 | 14.4 | 12.4 | 32.2 | 11.9 | 5.8 |
| Porosity, % | 2.4 | 0.79 | 0.55 | 0.28 | 0.62 | 0.30 |
| Apparent Density, g/cm³ | 7.89 | 8.01 | 7.94 | 7.97 | 7.97 | 7.94 |
| | | | HEAT 4 | | | |
| Weight, % | 23.7 | 16.1 | 10.9 | 23.7 | 6.6 | 3.1 |
| Porosity, % | 1.7 | 0.88 | 0.55 | 0.33 | 0.12 | 0.00 |

EXAMPLE III

A heat of the composition shown as No. 3 in Table I was prepared in a manner identical to that described previously for Heat 1, except that 0.025% calcium (as a nickel, 5% calcium master alloy) was added to the melt in place of magnesium. Powder from this heat had a residual calcium content of 0.0076%.

As shown in Table II, this heat exhibited less porosity by void counting in the −40, +60 mesh fraction than the control Heat A; however, somewhat more than Heat 1 prepared with magnesium. The remainder of the mesh size fractions were relatively free from porosity and comparable to the values obtained for magnesium-treated heats. The apparent density of the calcium-treated metal powder as measured by pycnometer was greater than the density of powders that had not been treated with calcium and essentially equivalent to magnesium-treated powder.

EXAMPLE IV

This example illustrates the suitability of the powdered metal prepared by the method of this invention to hot working operations.

A magnesium-containing heat, No. 4 in Table I, was argon atomized using four 4 mm gas jets set at a 22° included angle and four set at a 25° angle. Argon pressure ranged from 690 to 1030 kPa (100 to 150 psig), and the pouring temperature was 1425° C.

The −60 mesh powder was placed in a 9 cm diameter by 23 cm high mild steel can. The can was subsequently evacuated, sealed, presoaked at 1120° C for 3 hours, and extruded into a 2 × 3 cm bar.

The bar was reheated at 1120° C for 15 minutes and hot rolled 30%. The 1.4 cm thick plate was free from edge cracking, hot tears, and other defects associated with the presence of argon.

Although the exact mechanism for the formation of inert gas voids within an inert gas atomized powder metallurgy compact is not completely understood and without being bound to any particular theory, it is believed that the gas, e.g., argon, is entrapped during atomization as a result of the collision of individual metal particles. Specifically, it is believed that smaller, solidified particles traveling at high velocity within the gas stream penetrate larger, molten metal powder particles. Collision with a larger particle results in distortion of the large particle into a bag shape. This shape subsequently collapses and seals together behind the penetrating small particle entrapping both the particle and inert gas from the atomizing gas stream.

The addition of an activating agent such as magnesium, calcium, lithium, silicon, and rare earths prior to inert gas atomization substantially reduces porosity. It is believed that these activating agents serve to rapidly form a protective oxide film on the surface of the metal powder particles during atomization. Because of their high affinity for oxygen, these elements seek out and combine with oxygen from the atomizing gas at the surface of the metal powder particles. Migration of these active elements to the surface of the powder particles is believed to be associated with their ability to lower the surface tension of molten metals. It is believed that the rapid formation of a tough oxide skin, particularly on the larger powder particles, decreases the potential for penetration of the partially solidified large particles by high-velocity, solidified smaller particles. X-ray diffraction analysis of magnesium-treated, argon atomized superalloy powders has shown the presence of the compounds $NiO.Cr_2O_3$, $NiO.Al_2O_3$, $MgO.(Al.Cr)_2O_3$, and $MgO.Cr_2O_3$ on the surface of the powders which lends support to the foregoing.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process for substantially reducing gas entrapment in an inert gas atomized metal powder comprising: melting a metal alloy, activating said metal alloy by addition of from about 0.001 to about 0.1% by weight of an activating agent, selected from the group consisting of magnesium, calcium, lithium, silicon, and rare earths and atomizing said metal alloy containing said activating agent by contact with a high velocity inert gas.

2. A process as defined in claim 1, wherein said activating agent is present in said gas atomized metal powder in an amount from about 0.007 to about 0.08%.

3. A process as defined in claim 1, wherein said activating agent is magnesium.

4. A process as defined in claim 1, wherein said activating agent is calcium.

5. A process as defined in claim 1, wherein said high velocity inert gas is argon.

6. A process as defined in claim 5, wherein said metal alloy is selected from the group consisting of high-nickel alloys and highly alloyed steel.

7. A process as defined in claim 6, wherein said metal alloy is heated to a temperature that is from about 85° to about 135° C above the melting point of said metal alloy.

8. A process as defined in claim 7, wherein said metal alloy is a high-nickel alloy containing from about 10 to about 30% chromium, up to about 50% iron, up to about 20% cobalt, up to about 30% molybdenum, up to about 12% tungsten, up to about 8% tantalum, up to about 7% aluminum, up to about 5% titanium, up to about 4% columbium, up to about 0.1% boron, up to about 0.1% zirconium, and the balance essentially nickel.

9. An inert gas atomized metal powder containing, in weight percent, less than about 0.03% of an atomizing gas, and from 0.001 to about 0.1% of at least one activating agent selected from the group consisting of magnesium, calcium, lithium, silicon, and rare earths, said at least one activating agent concentrated on the surface of said metal powder.

10. An inert gas atomized metal powder as defined in claim 9, wherein said gas atomized metal powder is an alloy selected from the group consisting of high-nickel alloys and highly alloyed steels.

11. An inert gas atomized metal powder as defined in claim 10, wherein said metal powder is a nickel-base alloy containing from about 10 to about 30% chromium, up to about 50% iron, up to about 20% cobalt, up to about 30% molybdenum, up to about 12% tungsten, up to about 8% tantalum, up to about 7% aluminum, up to about 5% titanium, up to about 4% columbium, up to about 0.1% boron, up to about 0.1% zirconium, from about 0.001 to about 0.1% of at least one activating agent selected from the group consisting of magnesium, calcium, lithium, silicon, and rare earths, and the balance essentially nickel.

12. An inert gas atomized metal powder as defined in claim 11, wherein said atomizing gas is argon.

13. An argon atomized metal powder as defined in claim 12, wherein said activating agent is magnesium.

14. An argon atomized metal powder as defined in claim 13, wherein said activating agent is calcium.

* * * * *